US006662601B2

(12) United States Patent
Chang

(10) Patent No.: US 6,662,601 B2
(45) Date of Patent: Dec. 16, 2003

(54) GUIDE ROLLER-FREE AIRFLOW TYPE DYEING MACHINE

(76) Inventor: Chi-Lung Chang, PO Box 82-144, Taipei (TW)

( * ) Notice: Subject to any disclaimer, the term of this patent is extended or adjusted under 35 U.S.C. 154(b) by 231 days.

(21) Appl. No.: 09/986,516

(22) Filed: Nov. 1, 2001

(65) Prior Publication Data

US 2003/0079505 A1 May 1, 2003

(51) Int. Cl.[7] ..... D06B 5/08
(52) U.S. Cl. ..... 68/20; 68/177; 68/178
(58) Field of Search ..... 68/15, 177, 178, 68/179, 184, 20

(56) References Cited

U.S. PATENT DOCUMENTS 3,587,256 A * 6/1971 Spara
3,718,012 A * 2/1973 Vinas
3,771,337 A * 11/1973 Trullas
4,360 A * 11/1982 Putnam
4,445,346 A * 5/1984 Witt
4,483,032 A * 11/1984 Christ et al.
4,538,432 A * 9/1985 Bishop
4,766 A * 8/1988 Bianclain et al.
5,608,955 A * 3/1997 Bozzo
5,775,136 A * 7/1998 Chao-Cheng
5,850,651 A * 12/1998 Ishimaru et al.

FOREIGN PATENT DOCUMENTS

DE 3605123 * 12/1986
FR 2619834 * 3/1989
GB 2073797 * 10/1981

* cited by examiner

*Primary Examiner*—Frankie L. Stinson
(74) *Attorney, Agent, or Firm*—Leong C. Lei

(57) ABSTRACT

A guide roller-free airflow type dyeing machine includes a machine base defining a cylindrical receiving chamber and a cloth passage for the circulation of a fed piece of cloth, a jet nozzle upwardly mounted in one end of the cloth passage and adapted for ejecting a liquid coloring matter to dye the fed piece of cloth and to move the fed piece of cloth through the cloth passage, an air blower adapted for providing forced air to the jet nozzle to force liquid coloring matter out of the jet nozzle to the fed piece of cloth, a heat exchanger adapted for controlling the temperature of liquid coloring matter, and pump adapted for forcing liquid coloring matter to circulate through the jet nozzle and the heat exchanger.

2 Claims, 2 Drawing Sheets

GUIDE ROLLER-FREE AIRFLOW TYPE DYEING MACHINE

BACKGROUND OF THE INVENTION

The present invention relates to a dyeing machine and, more particularly, to a guide roller-free airflow type dyeing machine, which eliminates the use of cloth guide rollers, so as to reduce friction resistance to the fed piece of cloth, to lower tension from the fed piece of cloth, and to prevent the fed piece of cloth from wrinkling.

A conventional airflow type dyeing machine is known comprising a machine base defining a receiving chamber and a cloth passage, a jet nozzle mounted inside the machine base and adapted for ejecting a liquid coloring matter to the fed piece of cloth being circulated through the receiving chamber and the cloth passage, an air blower disposed outside the machine base and controlled to provide forced air to the jet nozzle, a pump adapted for pumping a liquid coloring matter to the jet nozzle for mixing with forced air from the air blower for dyeing the fed piece of cloth, a heat exchanger disposed outside the machine base and connected between the pump and the jet nozzle for controlling the temperature of the liquid coloring matter, a filter connected between the heat exchanger and the pump and adapted for removing solid matter from the liquid coloring matter. This structure of dyeing machine uses forced air and cloth guide rollers to guide circulation of the fed piece of cloth in the machine base, and the pump enables the supplied liquid coloring matter to be circulated through the jet nozzle. Because cloth guide rollers are used to guide movement of the fed piece of cloth, a friction resistance is produced and acted at the fed piece of cloth during dyeing operation. When the fed piece of cloth passed over the guide rollers toward the jet nozzles, the fed piece of cloth tends to be wrinkled, or the surface structure of the fed piece of cloth tends to be damaged by the cloth guide rollers.

SUMMARY OF THE INVENTION

The present invention has been accomplished to provide a guide roller-free airflow type dyeing machine, which eliminates the aforesaid problem. It is one object of the present invention to provide a guide roller-free airflow type dyeing machine, which eliminates the use of cloth guide rollers. It is another object of the present invention to provide a guide roller-free airflow type dyeing machine, which uses an upward ejecting force of liquid coloring matter ejected from a jet nozzle to move the fed piece of cloth. According to one aspect of the present invention, the dyeing machine comprises a machine base defining a cylindrical receiving chamber and a cloth passage for the circulation of a fed piece of cloth, and a jet nozzle upwardly mounted in one end of the cloth passage and adapted for ejecting a liquid coloring matter to dye the fed piece of cloth and to move the fed piece of cloth through the cloth passage. According to another aspect of the present invention, the cloth passage has a front end terminating in a smoothly arched front bent, which holds the jet nozzle for smooth circulation of the fed piece of cloth. Because the dyeing machine does not use any cloth guide rollers, all the drawbacks seen in the aforesaid prior art airflow type dyeing machine due to the use of cloth guide rollers are eliminated. According to still another aspect of the present invention, an air blower is used and controlled to provide forced air to the jet nozzle to mix with the supplied liquid coloring matter, so that fine drops of liquid coloring matter are forced out of the jet nozzle to dye the fed piece of cloth and to move the fed piece of cloth smoothly forwards through the cloth passage. According to still another aspect of the present invention, a heat exchanger is provided and adapted for controlling the temperature of the supplied liquid coloring matter. According to still another aspect of the present invention, a filter is provided and adapted for removing solid matter from the circulated liquid coloring matter.

DETAILED DESCRIPTION OF THE PREFERRED EMBODIMENT

Figure 1:
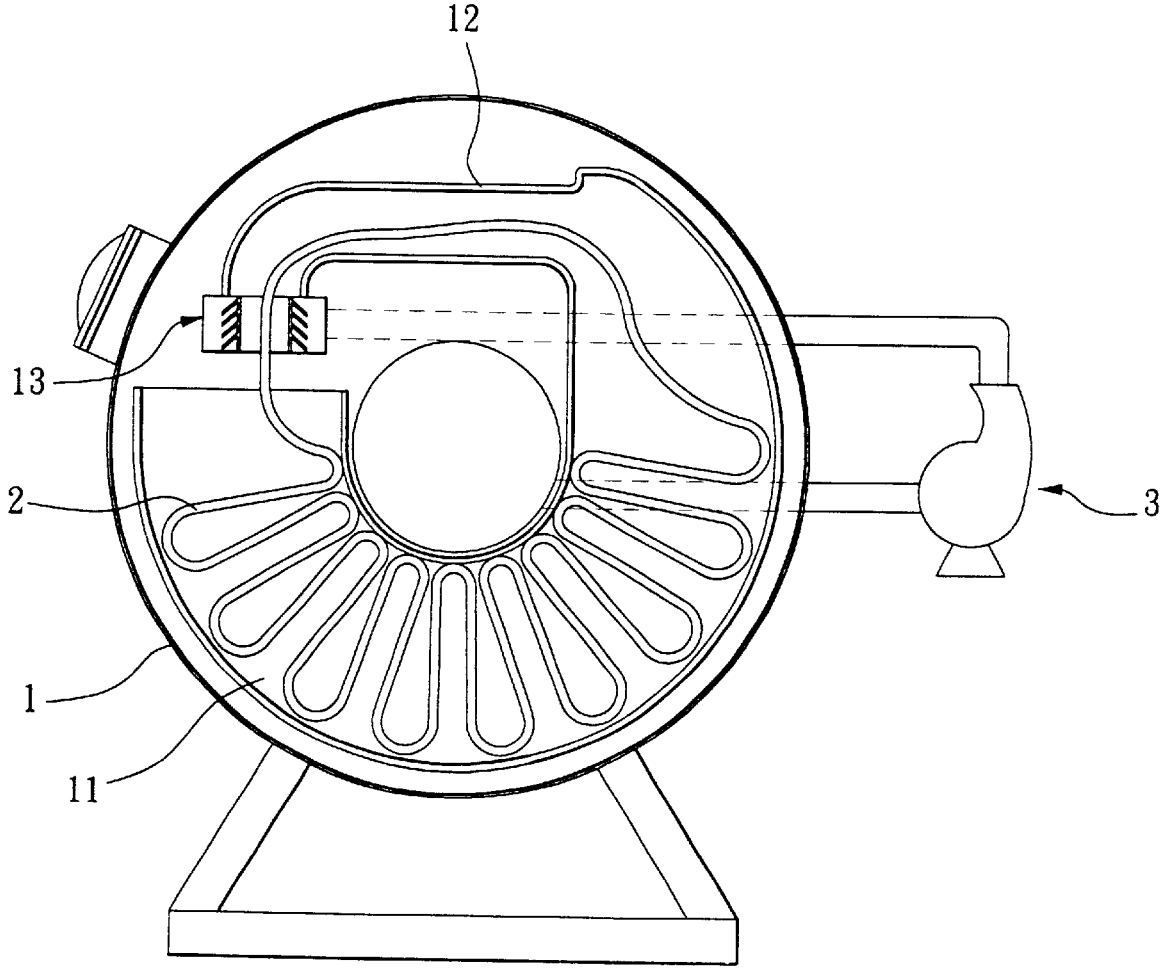
FIG. 1 is a plain view of a part of the present invention showing the fed piece of cloth circulated through the receiving chamber, the cloth passage, and the jet nozzle in the machine base according to the present invention.
Figure 2:
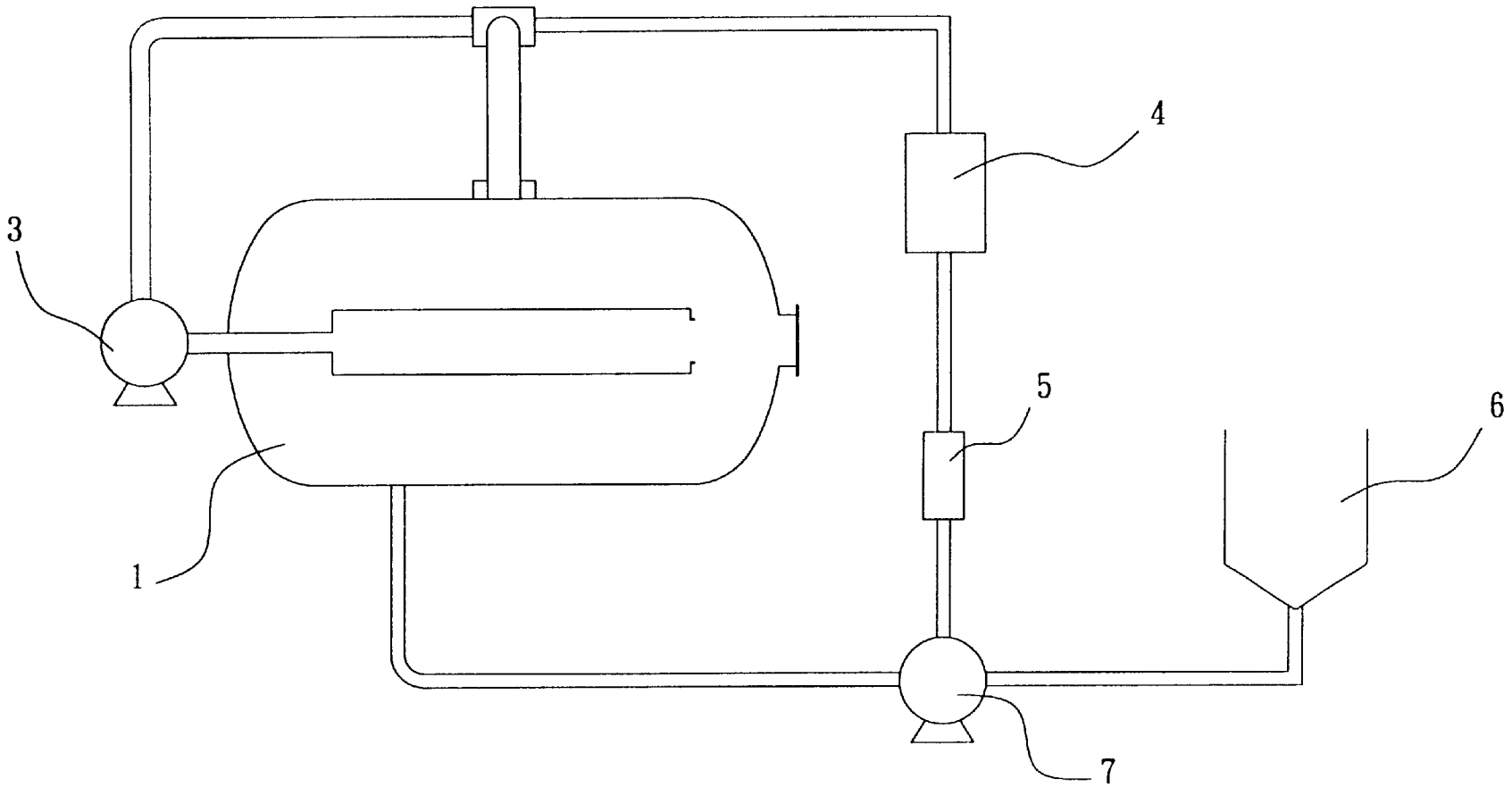
FIG. 2 is a top plain view of the dyeing machine constructed according to the present invention.

Referring to FIGS. 1 and 2, a dyeing machine is shown comprising a machine base 1, an air blower 3, a heat exchanger 4, a filter 5, a dyeing box 6, and a pump 7.

Referring to FIG. 1 again, the machine base 1 comprises a cylindrical receiving chamber 11, a cloth passage 12, and a jet nozzle 13. The cloth passage 12 has a front end terminating in a smoothly arched front bent, and a rear output end connected to one end of the receiving chamber 11. The jet nozzle 13 is coupled to the front input end of the cloth passage 12 and arranged in an upwardly extended position. The input end of the jet nozzle 13 faces downwards and aimed at the other end of the receiving chamber 11. Thus, the jet nozzle 13, the cloth passage 12, and the receiving chamber 11 form a continuous cloth circulation path.

Referring to FIGS. 1 and 2 again, the air blower 3 is connected to the jet nozzle 13 in the machine base 1 by a piping. The heat exchanger 4 is connected to the air output end of the air blower 3 by a piping.

During dyeing operation, the pump 7 draws liquid coloring matter out the machine base 1 into the heat exchanger 4, for enabling liquid coloring matter to be heated or cooled down, the air blower 3 is controlled to blow air to the jet nozzle 13, enabling forced air to be mixed with liquid coloring matter from the heat exchanger 4 and then driven out of the jet nozzles into fine drops of liquid coloring matter to dye the piece of cloth 2 circulating in the machine base 1. At the same time, the pump 7 draws accumulated liquid coloring matter out of the receiving chamber 11 for circulation through the filter 5 and the heat exchanger 4 toward the jet nozzle 13.

Referring to FIG. 1 again, when a piece of cloth 2 fed into the machine base 1 of the dyeing machine, it is circulated through the receiving chamber 11 and the cloth passage 12. When the fed piece of cloth 2 passes from the receiving chamber 11 into the cloth passage 12 through the jet nozzle 13, a liquid coloring matter is ejected upwards from the jet nozzle 13 toward the moving piece of cloth 2 to dye the moving piece of cloth 2 and simultaneously to force the moving piece of cloth 2 into the cloth passage 12. Because the invention eliminates the use of cloth guide rollers to guide movement of the fed piece of cloth, all the drawbacks produced due to the installation of cloth guide rollers in the dyeing machine are eliminated.

A prototype of dyeing machine has been constructed with the features of FIG. 1. The dyeing machine functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A guide roller-free airflow type dyeing machine comprising a machine base defining a cylindrical receiving chamber and a cloth passage for the circulation of a fed piece of cloth, and a jet nozzle adapted for ejecting a liquid coloring matter to dye the fed piece of cloth, wherein said cloth passage has a front end terminating in a smoothly arched front bent; said jet nozzle is coupled to the front bent of said cloth passage and arranged in an upwardly extended position, having an input end downwardly facing an opposite end of said receiving chamber.

2. The guide roller-free airflow type dyeing machine as claimed in claim 1 further comprising an air blower connected to said jet nozzle and controlled to blow air out of said jet nozzle toward the fed piece of cloth passing through said cloth passage.

* * * * *